United States Patent [19]

Hampton

[11] 4,060,894

[45] Dec. 6, 1977

[54] CHAIN SAW SAFETY BAR

[76] Inventor: Harvie G. Hampton, 1863 S. Brookwood, Shreveport, La. 71108

[21] Appl. No.: 750,665

[22] Filed: Dec. 15, 1976

[51] Int. Cl.[2] ..... B27B 17/02

[52] U.S. Cl. ..... 30/382

[58] Field of Search ..... 30/382, 161, 390, 391; 51/268

[56] References Cited

U.S. PATENT DOCUMENTS

| | | | |
|---|---|---|---|
| 2,937,673 | 5/1960 | Duperron | 30/382 |
| 3,754,328 | 8/1973 | Knerr | 30/382 |

FOREIGN PATENT DOCUMENTS

| | | | |
|---|---|---|---|
| 746,304 | 11/1966 | Canada | 30/382 |

*Primary Examiner*—Jimmy C. Peters
*Attorney, Agent, or Firm*—John M. Harrison

[57] ABSTRACT

A safety bar for chain saws which includes a bar latch pivotally mounted on the chain saw frame above the chain bar and having a protective bar projecting from the bar latch and extending the length of the chain and chain bar. The projecting bar protects the user in the event the saw suddenly recoils and dislodges the user's grip on the handle while in use. The safety bar mechanism permits the safety bar to automatically pivot upwardly as cutting is accomplished from the top to the bottom of a saw stock, and is capable of being pivotally manipulated to the underside of the chain saw when it is desired to cut from the bottom to the top of the stock.

10 Claims, 7 Drawing Figures

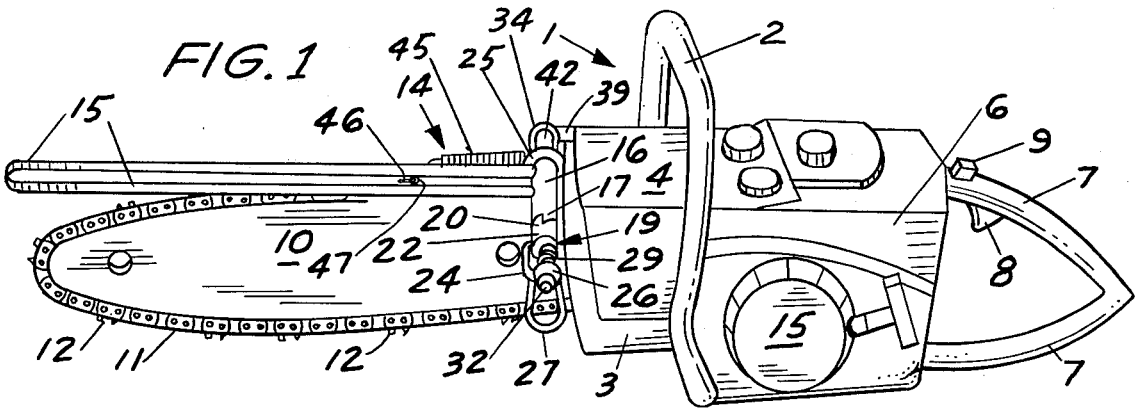
FIG. 1
1
2
3
4
6
7
8
9
10
11
12
14
15
16
17
19
20
22
24
25
26
27
29
32
34
39
42
45
46
47
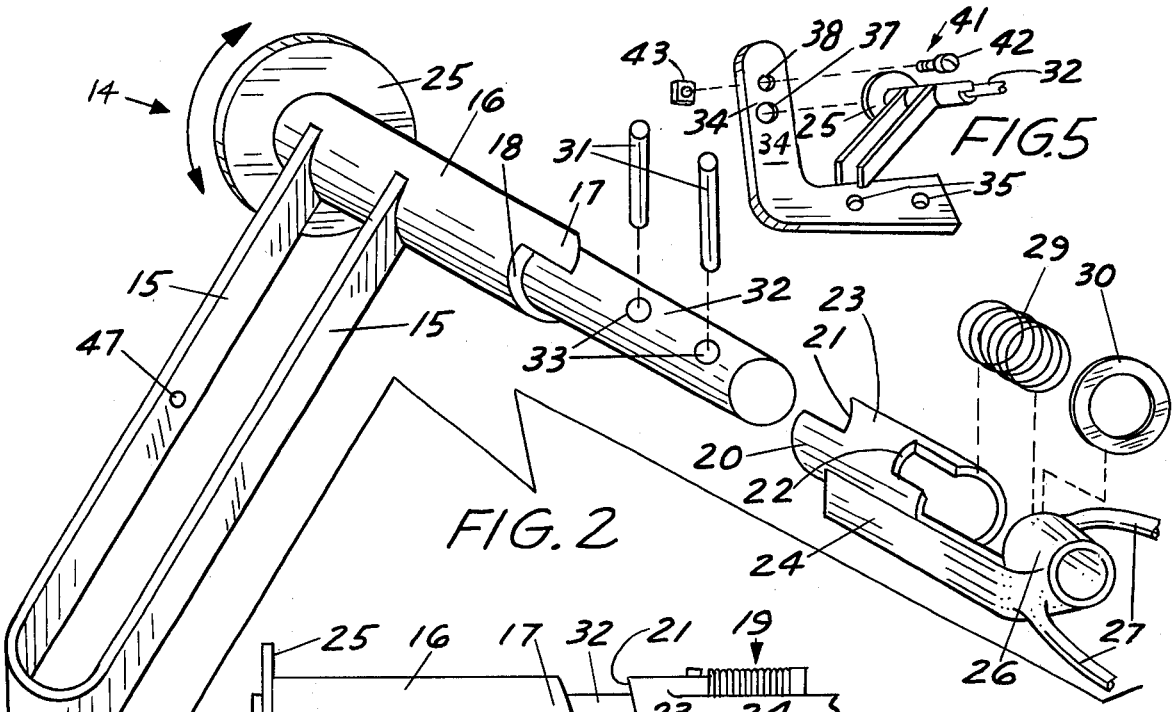
FIG. 2
14
15
16
17
18
21
22
23
24
25
26
27
29
30
31
32
33
47
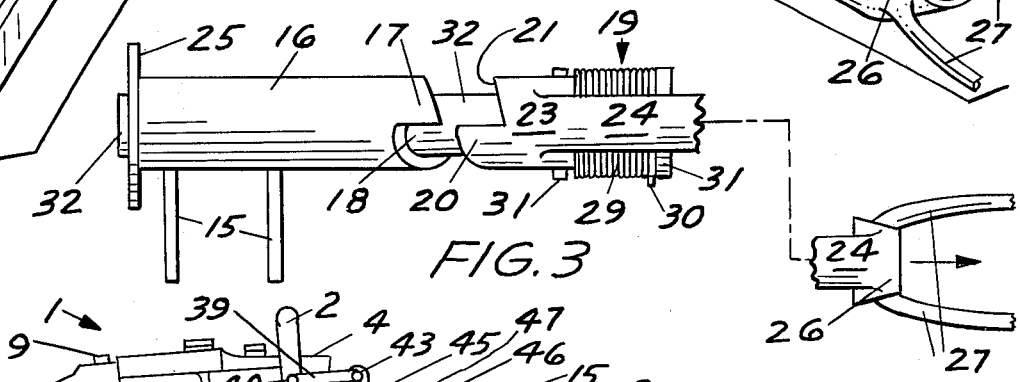
FIG. 3
15
16
17
18
19
20
21
23
24
25
26
27
29
30
31
32
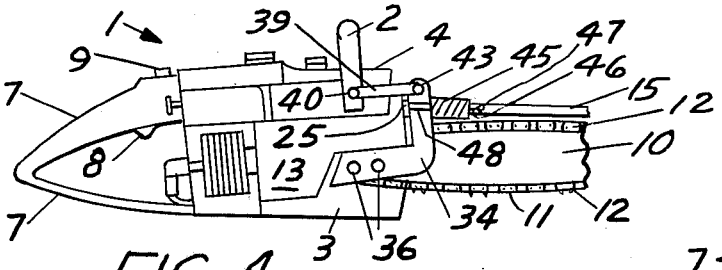
FIG. 4
1
2
3
4
7
8
9
10
11
12
13
15
25
34
36
39
40
43
45
46
47
48
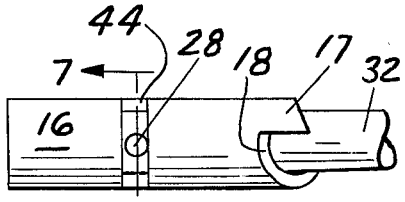
FIG. 6
7
16
17
18
28
32
44
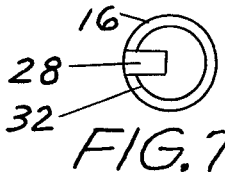
FIG. 7
16
28
32
FIG. 5
25
31
32
34
35
37
38
41
42
43

CHAIN SAW SAFETY BAR

BACKGROUND OF THE INVENTION

1. Field of the Invention

This invention relates to a new and improved guard means for chain saws, and more particularly to a new and improved safety bar and safety bar mechanism for mounting on chain saws, which mechanism is capable of preventing serious injury to the user in the event the chain saw recoils or kicks upwardly during operation. The safety bar mechanism of this invention is pivotally mounted on the chain saw above the chain bar and chain, and automatically pivots upwardly as cutting is accomplished from top to bottom of a log or other saw stock. The safety bar may also be pivotally positioned below the chain and chain bar when it is desired to cut the stock from bottom to top. The safety bar mechanism is simple, highly reliable, and provides a high degree of protection to the user, and at the same time adds very little weight and no appreciable bulk to the chain saw. The mechanism can also be designed to be compatible with virtually any chain saw currently manufactured.

2. Description of the Prior Art

Heretofore, various means have been utilized in the prior art to protect the user of chain saws from injury. One of the chief hazards in using a chain saw is the likelihood of the saw suddenly recoiling, or kicking and bouncing upwardly and rearwardly when the chain strikes a knot, nail, or hard portion of the log or other saw stock being cut. Such an occurrence frequently causes the handle of the chain saw to be suddenly jerked from the user's hand as the saw pivots about the user's grip on the grip bar, and permits the rapidly rotating chain to contact and injure the user. Special tips have been mounted on chain saw bars in order to minimize such occurrences, but these tips have not entirely solved the problem. Various other protective devices have been mounted forward of the grip bars on the frame members of chain saws to provide a means of preventing the saws from pivoting in the event of such a recoil, but use of such guards has met with limited success.

Accordingly, it is an object of this invention to provide a new and improved chain saw guard, and particularly, a pivotally mounted chain saw guard and safety bar mechanism which provides positive protection against injury from chain saw recoil.

Yet another object of this invention is to provide a new and improved safety bar and safety bar mechanism for mounting on chain saws which permits the saw to operate in normal fashion while making ordinary cuts, while at the same time provides a positive measure of protection in the event of recoil or "kick backs" resulting when the saw strikes an exceptionally hard piece of wood, a nail or other material in the saw stock.

A still further object of the invention is to provide a safety bar and safety bar mechanism for mounting on chain saws which automatically and pivotally swings upwardly as ordinary cuts are made with the saw from top to bottom through a log or other saw stock, and which mechanism may be selectively manipulated and rotated downwardly to position the safety bar below the operating chain when it is desired to make a cut through the saw stock from bottom to top.

Another object of this invention is to provide a new and improved safety bar and safety bar mechanism or guard for chain saws which is characterized by a U shaped safety bar projecting from a pivoting bar latch mechanism and extending the entire length of the chain and chain bar, and which is further capable of being quickly and easily mounted to substantially any chain saw to provide positive protection against injury in the event the chain saw kicks rearwardly and/or upwardly in unexpected recoil during the cutting operation.

Yet another object of the invention is to provide a new and improved safety bar and safety bar mechanism for chain saws which features a U shaped safety bar extending the entire length of the chain saw bar and chain and which offers protection from all areas of the chain in the event of recoil during operation of the chain saw.

Another object of this invention is to provide a new and improved chain saw safety bar and safety bar mechanism which can be easily removed from and placed back on substantially any chain saw in a short amount of time with the use of ordinary tools.

SUMMARY OF THE INVENTION

These and other objects of the invention are provided in a safety bar and safety bar mechanism for chain saws which includes the following elements.

1. A shaft-mounted bar latch, the shaft of which is carried by a bracket or the frame of a chain saw, and the bar latch being located above the chain bar and chain. The bar latch includes a U shaped safety bar which projects from the bar latch body and extends substantially the entire length of and above the chain saw bar and chain;

2. A shaft-mounted bar latch lock which cooperates with the bar latch in selective lock-and-release relationship, and which is spring loaded to permit rotation of the U shaped safety bar downwardly when it is desired to make an upward cut with the chain saw; and 3. A bar return spring mounted in cooperation with the bar latch and chain saw frame to permit the U shaped safety bar to move upwardly against the bias of the return spring as ordinary cuts are made from top to bottom in a log or other saw stock, and return the bar to its original position after the cut is completed.

BRIEF DESCRIPTION OF THE DRAWINGS

The invention will be better understood in view of the following description presented with reference to the accompanying drawings:

FIG. 1 of the drawings is a perspective view of a conventional chain saw fitted with a preferred safety bar and safety bar mechanism of this invention;

FIG. 2 is a perspective, exploded view of the operating portion of the safety bar and safety bar mechanism of this invention;

FIG. 3 is a top elevation, partially in section, of the operating portion of the safety bar and safety bar mechanism illustrated in FIG. 2, more particularly showing a preferred means of effecting rotation of the U shaped safety bar;

FIG. 4 is a right side elevation, partially in section, of the chain saw and safety bar illustrated in FIG. 1, more particularly showing a preferred bracket for mounting the safety bar and safety bar mechanism to the chain saw;

FIG. 5 is a perspective view, partially in section, of a preferred mounting bracket and a portion of the safety bar and safety bar mechanism, more particularly illustrating a preferred technique of mounting the safety bar mechanism to the mounting bracket;

FIG. 6 is a side elevation, partially in section, of the bar latch and latch shaft means fitted with an alternative preferred pin-and-slot arrangement to rotatably secure the bar latch on the latch shaft; and FIG. 7 is a sectional view taken along lines 7—7 in FIG. 6 of the alternative pin-and-slot arrangement illustrated in FIG. 6.

DESCRIPTION OF THE PREFERRED EMBODIMENTS

Referring now to FIG. 1 of the drawing, a conventional chain saw is illustrated by reference numeral 1, and is fitted with grip bar 2, supporting frame member 3, fuel and oil housing 4, starter housing 5 and engine housing 6. Handle 7 is provided with a cooperating trigger 8 and switch 9 to facilitate speed control of chain 11, which is fitted to and traverses chain bar 10. Chain teeth 12 are positioned in spaced relationship on chain 11 as illustrated to effect cutting.

The safety bar and safety bar mechanism of this invention is illustrated by reference numeral 14 in FIG. 1, and includes U shaped safety bar 15 carried by bar latch 16 and the legs of which project in essentially parallel relationship over chain 11 and chain bar 10. One end of bar latch 16 is shaped to form bar latch tip 17 and bar latch recess 18, as is more particularly illustrated in FIGS. 2 and 3 of the drawing. Bar latch lock 19 is shaped to cooperate with bar latch 16, and is similarly fitted with bar latch lock tip 20 and bar latch lock recess 21, which together register with bar latch recess 18 and bar latch tip 17, respectively, as illustrated. Bar latch 16 and bar latch lock 19 are concentrically mounted on latch shaft 32; bar latch 16 is designed to rotate on latch shaft 32, while bar latch lock 19 is adapted to slide on latch shaft 32. Bar latch lock slot 22 is provided in bar latch lock barrel 23 to cooperate with one of latch spring pins 31 and permit sliding movement on latch shaft 32, but to prevent rotation of bar latch lock 19 with respect to latch shaft 32. Thus, while bar latch 16 is permitted to rotate on latch shaft 32 as hereinafter described, the one of latch spring pins 31 which registers with bar latch lock slot 22 prevents rotation of bar latch lock 19 with respect to latch shaft 32, as illustrated in FIGS. 2 and 3 of the drawing. Bar latch lock 19 further includes bar latch lock plate 24, which joins bar latch lock barrel 23 and pull ring mount 26. Pull ring mount 26 in turn carries pull ring 27, the function of which will become apparent as hereinafter described.

Referring again to FIGS. 2 and 3 of the drawing, latch spring 29 and latch spring washer 30 are positioned in concentric relationship on latch shaft 32 between latch spring pins 31, the latter of which are in turn positioned in registration with latch shaft pin apertures 33 in latch shaft 32. The bias of latch spring 29 thus effects releasable registration of bar latch tip 17 and bar latch lock recess 21, and of bar latch recess 18 and bar latch lock tip 20, respectively.

Referring now to FIGS. 4 and 5 of the drawing, bracket 34 is illustrated in mounted position on frame member 3 adjacent clutch plate guard 13 by means of bracket mount bolts 36, which register with bracket mount apertures 35 in bracket 34 and cooperate with matching threaded holes (not illustrated) in frame member 3. As shown in FIG. 5, one end of latch shaft 32 projects through bar latch mount 25, which carries bar latch 16, and fits tightly in latch shaft seat 37 in bracket 34 to prevent rotation of latch shaft 32 with respect to bracket 34. One end of bracket brace 39 is in turn secured to bracket 34 by means of bar latch mount bolt 41, which registers with bracket brace bolt aperture 38 in bracket 34, and threadably cooperates with bar latch mount bolt nut 43 to secure bracket brace 39 on bracket 34. The opposite end of bracket brace 39 is secured to grip bar 2 by means of bracket brace bolt 40. In addition to performing the function of securing bracket brace 39 to bracket 34, bar latch mount bolt 41 also serves to secure bar latch mount 25 rotatably against the inside of bracket 34 by the overlap between bar latch mount bolt head 42 and the peripheral edge of bar latch mount 25. This positioning of bar latch mount bolt 41 with respect to bar latch mount 25 prevents lateral movement of bar latch 16, U shaped safety bar 15 and bar latch mount 25 on latch shaft 32.

Referring again to FIGS. 1, 2 and 4 of the drawing, bar return spring 45 is illustrated in cooperation with U shaped safety bar 15 and bracket 34. Bar return spring 45 is secured in position between U shaped safety bar 15 and bracket 34 by bar return spring retainers 46, one of which engages bar aperture 47 (illustrated in FIG. 2) in one leg of U shaped safety bar 15, and the other of which engages bar return spring mount 48, which is secured to bracket 34, as illustrated in FIG. 4.

In operation, and referring again to FIGS. 1–5 of the drawing, the safety bar mechanism of this invention is utilized in the following manner. If it is desired to make an ordinary cut with chain saw 1 from top to bottom in a log, limb or other saw stock, then the cut is begun in ordinary fashion by placing chain bar 10 carrying rotating chain 11 on top of the log or stock, and as chain 11 cuts through the stock, U shaped safety bar 15 contacts the top of the log on either side of the cut and rotates upwardly against the bias of bar return spring 45 until the cut is completed. It will be appreciated that U shaped safety bar 15 and bar latch 16 are permitted to rotate on latch shaft 32 into at least a vertical position of U shaped safety bar 15 above chain saw 1, and 90° displaced from the original position, and more preferably, beyond the vertical, 90 degree position of safety bar 15. Conversely, when it is desired to make a cut from bottom to top of a specified log or saw stock, pull ring 27 may be grasped and pulled in the direction of the arrow as illustrated in FIG. 3 of the drawing to slidably displace bar latch lock 19 on latch shaft 32 and disengage bar latch tip 17 from bar latch lock recess 21, and bar latch lock tip 20 from bar latch recess 18. This action permits a downward rotation of U shaped safety bar 15 and bar latch 16 with respect to bar latch lock 19 to a position well below chain bar 10 and chain 11, and allows a conventional, upward cut of chain saw 1 to be effected, as desired. After the cut is completed U shaped safety bar 15 is easily rotated back into the locked configuration.

It will be appreciated that in the event an ordinary cut from top to bottom is made on a log or other saw stock with chain saw 1, and further in the event of a recoil of chain bar 10 and chain 11 during the course of such a cut, U shaped safety bar 15 will engage the chest, arm or head of a user as the saw rotates with grip bar 2 as a pivot point, and will thus protect the user from the rotating chain. Since the safety bar is U shaped with each leg of the U configuration positioned above and to one side of the chain, positive protection from the chain is afforded the user.

It will be further appreciated by those skilled in the art that various alternative mechanical features can be used in the safety bar mechanism of this invention as desired without departing from the spirit and scope of the invention, the features set forth in FIGS. 1–5 of the drawing being preferred embodiments only. Such alternative features may be dictated by such factors as cost or adaptation to a specific chain saw design. For example, it will be recognized that bar return spring 45 may be easily replaced by a coil spring which is concentrically mounted on latch shaft 32 and fitted in cooperation with bar latch mount 25. Furthermore, referring again to FIGS. 6 and 7 of the drawing, in another preferred embodiment of the invention, bar latch 16 can be fitted with a slot 44 of preselected length to accommodate latch shaft pin 28, fitted in a blind aperture in latch shaft 32. Bar latch 16 and U shaped safety bar 15 are therefore permitted to rotate on latch shaft 32 as above described, and may be subjected to the bias of bar return spring 45, or the coil spring discussed above, as desired; however, lateral movement of bar latch 16 and U shaped safety bar 15 on latch shaft 32 is prevented by the projecting end of latch shaft pin 28, and rotatable motion of bar latch 16 and U shaped safety bar 15 is limited by the length of slot 44.

It will be further appreciated that bracket 34 may be designed to cooperate with substantially any chain saw presently marketed in order that the safety bar mechanism 14 be made compatible with these saws. In yet another embodiment of the invention, bracket 34 may be eliminated altogether, and latch shaft 32 can be mounted directly in clutch plate guard 13 when the relative positions of bar latch 16 and bar latch lock 19 are reversed in design on latch shaft 32, and when U shaped safety bar 15 is offset to project over chain bar 10 and chain 11.

I claim:

1. A chain saw safety bar for a chain saw comprising:

a. a shaft carried by said chain saw;

b. a bar latch rotatably mounted on said shaft and having a bar latch tip and a bar latch recess on one end thereof;

c. a U shaped safety bar carried by said bar latch and extending above and essentially parallel to the chain and chain bar of said chain saw;

d. bar latch lock means slidably mounted on said shaft and having a bar latch lock tip and a bar latch lock recess cooperating with said bar latch tip and said bar latch recess of said bar latch to freely permit said bar latch and said U shaped safety bar to rotate upwardly with respect to said chain and said chain bar and to releasably permit said bar latch and said U shaped safety bar to rotate downwardly on said shaft;

e. safety bar bias means in said chain saw safety bar to bias said safety bar in essentially parallel relationship with respect to said chain and said chain bar; and f. retaining means in cooperation with said bar latch to prevent sliding movement of said bar latch on said shaft.

2. The chain saw safety bar of claim 1 further including bracket means mounted on said chain saw and carrying said shaft in essentially horizontal relationship above and perpendicular to the plane of said chain and said chain bar.

3. The chain saw safety bar of claim 1 further including a spring in cooperation with said bar latch lock means to bias said bar latch lock tip in registration with said bar latch recess and said bar latch tip in registration with said bar latch lock recess to permit free upward rotation of said bar latch and said U shaped safety bar on said shaft and selective downward rotation of said bar latch and said U shaped safety bar on said shaft when the bias of said spring is released.

4. The chain saw safety bar of claim 1 further including:

a. bracket means mounted on said chain saw and carrying said shaft in essentially horizontal relationship above, and perpendicular to the plane of said chain and said chain bar; and b. a latch spring in cooperation with said bar latch lock means to bias said bar latch lock tip in registration with said bar latch recess and said bar latch tip in registration with said bar latch lock recess to permit free upward rotation of said bar latch and said U shaped safety bar on said shaft and selective downward rotation of said bar latch and said U shaped safety bar on said shaft when the bias of said spring is released.

5. The chain saw safety bar of claim 1 wherein said bar latch lock means comprises a bar latch lock barrel slidably mounted on said shaft and fitted with a lock slot on one end thereof; a lock plate carried by said bar latch lock barrel and disposed beside said shaft in essentially parallel relationship; a pull ring mount mounted on said lock plate in spaced relationship from said bar latch lock barrel and slidably mounted on said shaft; a pull ring carried by said pull ring mount; a latch spring and latch spring washer disposed on said shaft between said lock slot and said pull ring mount; a first latch spring pin inserted in a first aperture in said shaft and registering with said lock slot; and a second latch spring pin spaced from said first latch spring pin and inserted in a second aperture in said shaft to permit slidable displacement of said bar latch lock means on said shaft against the bias of said latch spring to disengage said bar latch lock tip from registration with said bar latch recess and said bar latch tip from registration with said bar latch lock recess.

6. The chain saw safety bar of claim 1 further comprising:

a. bracket means mounted on said chain saw and carrying said shaft in essentially horizontal relationship above and perpendicular to the plane of said chain and said chain bar;

b. a latch spring in cooperation with said bar latch lock means to bias said bar latch lock tip in registration with said bar latch recess and said bar latch tip in registration with said bar latch lock recess to permit free upward rotation of said bar latch and said U shaped safety bar on said shaft and selective downward rotation of said bar latch and said U shaped safety bar on said shaft when the bias of said spring is released; and wherein said bar latch lock means comprises a bar latch lock barrel slidably mounted on said shaft and fitted with a lock slot on one end thereof; a lock plate carried by said bar latch lock barrel and disposed beside said shaft in essentially parallel relationship; a pull ring mount mounted on said lock plate in spaced relationship from said bar latch lock barrel and slidably mounted on said shaft; a pull ring carried by said pull ring mount; a latch spring washer disposed on said shaft between said latch spring and said pull ring mount; a first latch spring pin inserted in a first aperture in said shaft and registering with said lock slot; and a second latch spring pin spaced from said first latch spring pin and inserted in a second aperture in said shaft to permit slidable displacement of said bar latch lock means on said shaft against the bias of said latch spring to disengage said bar latch lock tip from registration with said bar latch recess and said bar latch tip from registration with said bar latch lock recess.

7. The chain saw safety bar of claim 2 wherein said retaining means comprises a round, flat bar latch mount plate on the end of said bar latch opposite said bar latch tip and said bar latch recess, and a bar latch mount bolt positioned through said bracket means with the head of said bar latch mount bolt overlapping the edge of said bar latch mount plate to prevent substantial sliding movement of said bar latch on said shaft, but permitting rotation of said bar latch and said safety bar on said shaft.

8. The chain saw safety bar of claim 1 further comprising bracket means mounted on said chain saw and carrying said shaft in essentially horizontal relationship above and perpendicular to the plane of said chain and said chain bar; and a latch spring in cooperation with said bar latch lock means to bias said bar latch lock tip in registration with said bar latch recess and said bar latch tip in registration with said bar latch lock recess to permit free upward rotation of said bar latch and said U shaped safety bar on said shaft and selective downward rotation of said bar latch and said U shaped safety bar on said shaft when the bias of said spring is released, and wherein:

a. said bar latch lock means comprises a bar latch lock barrel slidably mounted on said shaft and fitted with a lock slot on one end thereof; a lock plate carried by said bar latch lock barrel and disposed beside said shaft in essentially parallel relationship; a pull ring mount mounted on said lock plate in spaced relationship from said bar latch lock barrel and slidably mounted on said shaft; a pull ring carrier by said pull ring mount; a latch spring washer disposed on said shaft between said latch spring and said pull ring mount; a first latch spring pin inserted in a first aperture in said shaft and registering with said lock slot; and a second latch spring pin spaced from said first latch spring pin and inserted in a second aperture in said shaft to permit slidable displacement of said bar latch lock means on said shaft against the bias of said latch spring to disengge said bar latch lock tip from registration with said bar latch recess and said bar latch tip from registration with said bar latch lock recess; and b. said retaining means comprises a round, flat bar latch mount plate on the end of said bar latch opposite said bar latch tip and said bar latch recess, and a bar latch mount bolt positioned through said bracket means with the head of said bar latch mount bolt overlapping the edge of said bar latch mount plate to prevent substantial sliding movement of said bar latch on said shaft, but permitting rotation of said bar latch and said safety bar on said shaft.

9. The chain saw safety bar of claim 1 wherein said retaining means is a slot in said bar latch and a cooperating pin mounted in said shaft and projecting through said slot to limit the rotational travel of said bar latch and said U shaped safety bar on said shaft.

10. The chain saw safety bar of claim 1 comprising bracket means mounted on said chain saw and carrying said shaft in essentially horizontal relationship above and perpendicular to the plane of said chain and said chain bar; and a latch spring in cooperation with said bar latch lock means to bias said bar latch lock tip in registration with said bar latch recess and said bar latch tip in registration with said bar latch lock recess to permit free upward rotation of said bar latch and said U shaped safety bar on said shaft and selective downward rotation of said bar latch and said U shaped safety bar on said shaft when the bias of said spring is released, and wherein:

a. said bar latch lock means comprises a bar latch lock barrel slidably mounted on said shaft and fitted with a lock slot on one end thereof; a lock plate carried by said bar latch lock barrel and disposed beside said shaft in essentially parallel relationship; a pull ring mount mounted on said lock plate in spaced relationship from said bar latch lock barrel and slidably mounted on said shaft; a pull ring carried by said pull ring mount; a latch spring washer disposed on said shaft between said latch spring and said pull ring mount; a first latch spring pin inserted in a first latch spring pin and inserted in a second aperture in said shaft to permit slidable displacement of said bar latch lock means on said shaft against the bias of said latch spring to disengage said bar latch lock tip from registration with said bar latch recess and said bar latch tip from registration with said bar latch lock recess; and b. said retaining means comprises a slot in said bar latch and a cooperating pin mounted in said shaft and projecting through said slot to limit the rotational travel of said bar latch and said U shaped safety bar on said shaft.

* * * * *

UNITED STATES PATENT OFFICE

CERTIFICATE OF CORRECTION

Patent No. 4,060,894 Dated December 6, 1977

Inventor(s) Harvie G. Hampton

It is certified that error appears in the above-identified patent and that said Letters Patent are hereby corrected as shown below:

Column 5, line 33, after the number 11, and in a new paragraph, the following should be inserted -- Accordingly, having described my invention with the particularity set forth above, what is claimed is: --.

Column 5, line 34, delete "I claim:"

Claim 8, line 39, "carrier" should be -- carried --.

Signed and Sealed this

*Eleventh* Day of *July 1978*

[SEAL]

*Attest:*

RUTH C. MASON
*Attesting Officer*

DONALD W. BANNER
*Commissioner of Patents and Trademarks*